United States Patent [19]

Lawson et al.

[11] 4,033,784

[45] July 5, 1977

[54] METHOD FOR DISSOLVING ASPHALTIC MATERIAL

[75] Inventors: Michael B. Lawson; Kenneth J. Snyder, both of Duncan, Okla.

[73] Assignee: Halliburton Company, Duncan, Okla.

[22] Filed: Aug. 25, 1975

[21] Appl. No.: 607,653

[52] U.S. Cl. ..... 134/20; 106/278; 134/39; 134/40; 208/45; 208/323; 208/326; 252/364; 252/542

[51] Int. Cl.[2] ..... B08B 3/08

[58] Field of Search ..... 134/20, 39, 40; 252/82, 252/153, 542, 364, 544; 208/45, 323, 326; 106/278

[56] References Cited

UNITED STATES PATENTS

| | | | |
|---|---|---|---|
| 1,786,860 | 12/1930 | Midgley et al. | 134/20 |
| 1,833,429 | 11/1931 | Lovell et al. | 252/153 X |
| 2,904,458 | 9/1959 | Dykstra et al. | 134/20 |
| 2,956,910 | 10/1960 | Giammaria | 134/39 UX |
| 2,964,429 | 12/1960 | Bland | 134/39 X |
| 3,794,523 | 2/1974 | Thompson | 134/40 X |
| 3,914,132 | 10/1975 | Sutton | 134/40 |

*Primary Examiner*—S. Leon Bashore
*Assistant Examiner*—Marc L. Caroff
*Attorney, Agent, or Firm*—Thomas R. Weaver; John H. Tregoning

[57] ABSTRACT

Asphaltic material is dissolved by contact with a solvent composition for a time sufficient to dissolve the asphaltic material wherein the solvent composition is comprised of a liquid heavy aromatic solvent having a high flash point and a fused heterocyclic ring compound or compounds soluble in the heavy aromatic solvent. In another embodiment, the asphaltic material is the binder material of a degraded organic residue whereby dissolution of the asphaltic material enables the convenient disintegration of the degraded organic residue. In still another embodiment, the solvent composition is the oil phase of an oil-water emulsion.

12 Claims, No Drawings

METHOD FOR DISSOLVING ASPHALTIC MATERIAL

This invention relates to the dissolution of asphaltic material. This invention also relates to a process for dissolving asphaltic material adhering to substrates. This invention still further relates to a process for removing carbonaceous scale which tightly adheres to various types of equipment.

Equipment utilized in the treatment of liquid organic materials containing low volatility, high melting point, polycyclic hydrocarbons such as asphalt, bitumens, asphaltenes, tar and similar constituents, which such constituents are referred to herein as asphaltic material, is often times fouled and/or damaged by the formation of precipitated deposits of asphaltic material on the surfaces of the equipment which are in contact with the liquid organic material being treated. The deposits of asphaltic material can build up over a period of time and eventually the build-up becomes so extensive as to unreasonably impair the efficient operation of the equipment. When operation of the equipment becomes thus impaired it becomes necessary to terminate its operation in order to remove the deposits.

When the deposits of asphaltic material are formed on heated surfaces of equipment, the asphaltic material can degrade to a hard, highly insoluble, residue material which is tightly adherent to the heated surface. This degraded asphaltic material is similar to coke. The extent to which the asphaltic material degrades to coke is a function of the length of time that the material is subject to the heated surface and the temperature of the surface itself. Thus, exposure of asphaltic material for a great period of time to extremely hot surfaces can produce virtually complete degradation of the asphaltic material to coke. However, where degradation is not complete, it is believed the degraded asphaltic material is held together by a binder consisting of the non-degraded asphaltic material. To thus distinguish between the asphaltic material which is virtually completely degraded, referred to herein as coke, the expression carbonaceous scale is adopted to identify the asphaltic material which is not completely degraded but which consists of coke bound by non-degraded asphaltic material. This invention is directed to dissolution of the asphaltic material and to disintergration of the carbonaceous scale.

Examples of the equipment referred to include, but are not limited to, heat exchangers, distillation column trays, reboilers, pipe stills and similar equipment utilized in refineries in the treatment of crude oil, atmospheric bottoms, vacuum bottoms, residual fuel oil and similar hydrocarbons which contain asphaltic material.

Carbonaceous scale has been removed from equipment by mechanical means such as scraping, sawing and jetting with high pressure liquids. It has also been attacked by chemical means such as with solvents consisting of chlorinated hydrocarbons. The methods presently used, although successful, do involve the expenditure of a great deal of time, in the case of the mechanical techniques, and the safety risks inherent in the use of chlorinated hydrocarbons. Chlorinated hydrocarbons produce vapors potentially hazardous to those subject to breathing them.

There is thus a need for a method for dissolving asphaltic material and disintegrating carbonaceous scale which avoids prolonged mechanical treatment and the use of vaporous chemicals.

Accordingly, by this invention there is provided a process for dissolving asphaltic material and for disintegrating carbonaceous scale. The process of this invention comprises contacting the asphaltic material with a solvent composition, hereinafter described, for a time sufficient to dissolve the asphaltic material. Where the asphaltic material contacted is the binder of carbonaceous scale, the asphaltic material dissolves thus leaving the undissolved, but weakened, coke matrix intact which thereafter disintegrates. The disintegration step can occur naturally or it can be enhanced or even caused by mechanical means such as the ones previously mentioned. Where carbonaceous scale adheres to a substrate a mere water flushing step, as distinguished from high pressure jetting, is all that may be required to promote disintegration and sloughing of the weakened matrix from the substrate. The process is completed by merely flushing the spent solvent compositions and disintegrated solid material from the surfaces of the substrate.

The deposits to be dissolved or otherwise disintegrated can be contacted with the solvent composition under several operating conditions: The contact can be static or the solvent composition can be circulated over the deposits; the contact can be effected at any temperature from about ambient, which is defined herein to be less than about 75° F, up to about the flash point of the solvent compositions which, as hereinafter explained, is at least about 160° F; and the contact can be effected with the solvent composition alone or with the solvent composition as the internal or external phase of an aqueous emulsion. Of course, combinations and variations of the above conditions can be utilized to establish contact between the deposits and the solvent. The only known critical element of the contact method selected is that it must assure that the asphaltic material be contacted with the solvent compositions in order to produce the desired weakening of the coke matrix as previously stated.

The currently preferred method of producing effective contact between the deposits and the solvent composition comprises circulating an aqueous emulsion of the solvent composition over the deposit at a temperature of slightly less than the flash point of the solvent composition for a time sufficient to dissolve the asphaltic material or to otherwise weaken or disintegrate the carbonaceous scale. This preferred method is particularly useful in the cleaning of industrial equipment of the type above described wherein large volumes of liquid are continually circulated through the equipment. Even though the liquid emulsion circulated does not solely consist of the active solvent composition, the emulsion nevertheless permits sufficient contact between the asphaltic material and solvent composition to effect dissolution of the asphaltic material. There is thus a savings in the quantity of active material required to perform a given cleaning procedure. Furthermore, the constant movement of the emulsion served to flush away the undissolved solid deposits. Operating at a temperature slightly less than the flash point of the solvent composition helps to prevent the generation of large quantities of vapor which could be annoying to those individuals involved in the cleaning process. Furthermore, since the flash point of the solvent composition, as mentioned above, is at least about 160° F, operating at a temperature slightly less than the flash point of the solvent composition offers the added advantage of utilizing heat to aid in the cleaning procedure.

The solvent composition of this invention is comprised of two essential active ingredients; a liquid organic solvent, known in the art as heavy aromatic solvent, and an additive, soluble in the heavy aromatic solvent, which significantly, and surprisingly, improves the ability of the heavy aromatic solvent to dissolve asphaltic material. In the previous portions of this disclosure there have been references made to the flash point of the solvent compositions. These references have been correct because the additive, being a solid under the conditions involved, has no flash point; however, the flash point of the solvent composition herein is actually the flash point of the liquid heavy aromatic solvent. Accordingly, the flash point of the liquid aromatic solvent useful herein is in the range of from about 160° F to about 350° F and preferably from about 180° F to about 250° F. A currently preferred heavy aromatic solvent has a flash point of about 200° F.

The heavy aromatic solvent useful herein is a high boiling refinery product comprised of a varying mixture of principally aromatic compounds. The aromatic compounds which can be included in the heavy aromatic solvent include: alkyl substituted benzene compounds wherein the alkyl substituents have about 1 to about 10 carbon atoms; naphthalene; alkyl substituted naphthalene wherein the alkyl substitutes have about 1 to about 10 carbon atoms; and mixtures of these compounds. Non-aromatic constituents such as kerosene, certain fuel oils, or any alkyl hydrocarbon, can be included in the heavy aromatic solvent but preferably in volume proportions of 5 percent or less.

The heavy aromatic solvent useful herein is also identified in terms of its physical properties. Table I below sets out the physical properties of some preferred heavy aromatic solvents useful herein. However, neither the specific properties named nor the values listed for each should be considered as limiting of the aromatic solvents useful.

naphthalene, 2-ethylnaphthalene,1,4-dimethylnaphthalene and the like.

The second of the two essential active ingredients of the solvent composition of this invention is an additive, soluble in the liquid heavy aromatic solvent above described, which improves the ability of the heavy aromatic solvent to dissolve asphaltic material. The additive is a compound or compounds selected from fused heterocyclic ring compounds, alkyl substituted derivatives of fused heterocyclic ring compounds and mixtures thereof. A typical fused heterocyclic ring compound and alkyl substituted derivatives thereof useful herein can contain one or more heteroatoms selected from nitrogen and oxygen providing that at least one heteroatom in the compound is nitrogen. The number of fused rings present in the heteromolecule is limited only by the solubility of the molecule in the liquid heavy aromatic solvent.

The preferred heteromolecules consist of fused five member rings, fused six member rings and fused 5 and 6 member rings. A still further preferred heteromolecule is one which conists of two fused rings, one being a five member ring and the second being a six member ring wherein the heteromolecule contains at least two heteroatoms.

The additives most preferred for use herein are 5 and 6 member heterocyclic ring compounds represented by the general formula

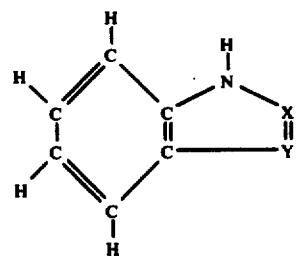

TABLE I

PHYSICAL PROPERTIES OF HEAVY AROMATIC SOLVENTS

| Physical Property | A | B | C | D | E | F | G | H | I |
|---|---|---|---|---|---|---|---|---|---|
| Gravity, ° API | 18.5 | 13.0 | 15.0 | 17.5 | 24 | 23.5 | 16.9 | 12.6 | 16.9 |
| Distillation, ° F | | | | | | | | | |
| IBP | 375 | 424 | 375 | 388 | 390 | 367 | 401 | 426 | 395 |
| 10% | 392 | 449 | 425 | 420 | 400 | 378 | 423 | 448 | 411 |
| 50% | 410 | 491 | 470 | 455 | 420 | 389 | 462 | 472 | 447 |
| 90% | 493 | 606 | 550 | 528 | 460 | 436 | 572 | 552 | 566 |
| EP | 626 | 686 | 660 | 625 | 550 | 586 | 662 | 666 | 648 |
| Color, ASTM | 3.0 | 4.5 | 3.5 | 3.0 | 1.5 | 2.5 | 3.0 | 2.0 | 2.0 |
| Aromatics, Vol. % | 99 | 98 | 98.5 | 99.7 | 95 | 100 | 100.0 | 100 | 99.2 |
| Mixed Aniline Pt., ° F | 50.5 | — | 55.5 | 64.5 | 70 | 60 | 61.5 | 54.5 | — |
| Flash Point ° F | 170 | 210 | 175 | 184 | 180 | 164 | 186 | 212 | 178 |
| Pour Point ° F | −25 | — | −45 | Below −35 | Below −30 | −30 | Below −75 | −40 | Below −90 |

A preferred liquid aromatic solvent has a flash point of about 200° F and consists essentially of alkyl substituted benzene compounds, alkyl substituted naphthalene compounds and mixtures thereof.

Examples of alkyl substituted benzene compounds useful herein are ethylbenzene, amylbenzene, 2-phenylbutane, t-butylbenzene,1,2-diethylbenzene,1,3-diethylbenzene,1,4-diethylbenzene and the like.

Examples of alkyl substituted naphthalene compounds useful herein are 1-methylnaphthalene, 1-ethylwherein X is N or CH, Y is N or CH; and mixtures thereof.

Specific examples of fused heterocyclic ring compounds and alkyl substituted derivatives thereof useful herein include indazole, benzimidazole, indoxazine, cinnoline, quinazoline, phthalazine, quinoxaline, benzotriazole, pterin, anthranil, benzoxazole, indole, methyl benzotriazole, quinoline, 4-methylcinnoline and tolytriazole.

The most preferred additive for use herein is benzotriazole.

The additive is present in the solvent composition in the range of from about 0.1 to about 50, preferably from about 0.3 to about 30, and still more preferably from about 0.5 to about 3 percent by weight of the liquid heavy aromatic solvent.

As previously mentioned the additive utilized herein, even in very small quantities, enhances the ability of the liquid heavy aromatic solvent to dissolve asphaltic material. For example, it can be seen from Example I, below, that a composition consisting of about 1 percent benzotriazole by weight of liquid heavy aromatic solvent surprisingly increasing the ability of the aromatic to dissolve asphaltic material by a factor of about 2.3. More surprisingly, addition of a very small quantity, that is less than 0.2 percent of natural gum by weight of aromatic, to the composition appears to even further improve the ability of the aromatic to dissolve asphaltic material. For example, it can be seen from Example I, below, that a composition consisting of liquid heavy aromatic solvent, about 1 percent benzotriazole by weight of aromatic solvent, and about 0.12 percent batu gum by weight of aromatic solvent increases the ability of the aromatic to dissolve asphaltic material by a factor of about 3.2.

As previously mentioned, this invention also includes within its scope an emulsion comprising the solvent composition of this invention and water wherein the solvent composition, hereinafter referred to as the oil phase, is present in the range of from about 2 to about 60 and preferably from about 30 to about 40 percent by volume of the emulsion. The oil phase is preferably the external phase of the emulsion; however, the oil phase can be the internal phase of the emulsion.

The emulsion also contains a suitable emulsifying agent in an amount sufficient to promote and stabilize the emulsion. The emulsifying agent can be anionic, cationic, nonionic, or amphoteric in nature and mixtures thereof; however, the emulsifiers currently preferred are nonionic in nature.

The amount of emulsifying agent to be employed is a function of the volume of emulsion; accordingly, the emulsifier is present in the emulsion in the range of from about 0.1 to about 5, preferably 0.5 to about 3.0 percent by volume of emulsion.

The preferred nonionic emulsifiers are ethylene oxide adducts of alkyl phenols and mixtures thereof, and of these the octyl and nonyl phenols having in the range of 1 to 10 ethylene oxide units are preferred.

The most preferred emulsifier is the ethylene oxide adduct of nonyl phenol having four ethylene oxide units and it is preferably present in the emulsion in a concentration of about 1.5 percent by volume of the emulsion.

The emulsion can also contain water softening compounds, for example trisodium phosphate, sodium metasilicate, hexametaphosphate and the like. These compounds are particularly important when anionic or cationic emulsifiers are employed. When employing anionic or cationic emulsifiers which are sensitive to the presence of divalent ions, fresh water should generally be used. However, hard water or brine, if properly treated with water-softening chemicals, such as trisodium phosphate or sodium hexametaphosphate, can be employed. Public water supply, if available, can be used with the sensitive emulsifiers. This water, however, should be tested for hardness and softened, if necessary. For each grain of hardness per gallon of water, about one pound of trisodium phosphate or 1-¼ pound of sodium hexametaphosphate per 100 barrels of water can be used to soften the water. As a general rule, the nonionic emulsifying agents are not sensitive to the divalent ions and therefore can be used in hard water as well as soft water.

The selection of the most efficient emulsifier and its concentration in the water phase will depend upon several factors, including the composition of the oil and water to be emulsified, the temperature, the type of blending equipment available, and the composition of the additives to be employed in the emulsion. The most efficient emulsifier or blends for a particular system may require a selection by a trial-and-error process. The trial-and-error selection can be aided and guided by the familiar hydrophile-lipophile-balance (HLB) method. Emulsifiers or blends of emulsifiers having HLB numbers in the range from 8 to 18 are generally considered oil-in-water emulsifiers. See *Emulsions: Theory and Practice*, By Becher, and published by Reinhold Publishing Corporation, New York, U.S.A., copyright 1957, for a detailed explanation of the HLB method and for a list of emulsifiers and corresponding HLB numbers.

Suitable anionic emulsifiers include the alkali, amine, and other fatty acid soaps. As is well known in the emulsion art, these soaps are the salts of long-chain fatty acids derived from naturally-occurring fats and oils. The mixed fatty acids of tallow, coconut oil, palm oil, and the like are the most commonly employed. Other sources of carboxylic acids include tall oil and rosin.

Although the cationic emulsifying agents are not widely used for promoting oil-in-water emulsions, some exhibit high HLB numbers indicating that they can be employed for this service. The cationic emulsifying agents of principal importance are the amines and quaternary ammonium salts such as polyoxyethylene sorbitol oleate-polyoxyethylene amine blend, polyoxyethylene alkyl amine, quaternary ammonium derivative, and N-cetyl N-ethyl morpholinium ethosulfate.

The nonionic emulsifying agents are generally independent of water hardness and pH and therefore are compatible with hard water. A few of the general purpose nonionic emulsifiers capable of promoting stable emulsions include polyoxyethylene sorbitan monolaurate, polyoxyethylene lauryl ether, polyoxyethylene monostearate, polyoxyethylene oxypropylene stearate, polyoxyethylene cetyl ether, polyoxyethylene sorbitan esters of mixed fatty and resin acids, polyoxyethylene glycol monopalmitate, and polyoxyethylene sorbitan monopalmitate.

A preferred commercial emulsion can be prepared by forming a solution consisting of 15.0 gallons of the ethylene oxide adduct of nonylphenol containing four ethylene oxide units, and 300 gallons of liquid heavy aromatic solvent having a flash point of about 200° F. After the above solution is formed, which is the previously referred to oil phase, it is blended with the previously formed water phase to thereby produce an oil external-water internal emulsion. Thirty pounds of benzotriazole are then added to the emulsion. The water phase is a solution which consists of 700 gallons of water, 175 pounds of sodium hydroxide, 58 pounds of trisodium phosphate and 58 pounds of sodium metasilicate. Preparation of the emulsion is not limited to the above described procedure.

The following examples will enable persons skilled in the art to further understand and practice the invention; however, the examples are not intended to limit the scope of this invention.

EXAMPLE I

The experimental procedure utilized in this example to determine the solubility of gilsonite is as follows:

Ten (10) grams of gilsonite, a naturally occurring asphaltic material, is placed in a vessel containing 50 milliliters of a solvent which is maintained at a temperature of 88° F. The solvent and gilsonite are maintained in the vessel together for a period of one hour at a temperature of 88° F with occasional agitation. At the end of the one hour dissolution period the contents of the vessel are filtered through a Whatman No. 541 filter paper to separate the undissolved gilsonite from the solvent-gilsonite solution, hereinafter referred to as the gilsonite solution.

The gilsonite solution is thereafter examined by a Colorimetric procedure to determine the solubility of gilsonite in the solvent under investigation relative to the same solvent which does not contain any gilsonite, which is hereinafter referred to as the standard solvent.

A 1 milliliter aliquot of the gilsonite solution and a 1 milliliter aliquot of the standard solvent are each mixed with 24 milliliters of mixed xylenes to thereby form two 25 milliliter solutions. Incandescent light is passed through each solution and the quantity of light passing through the solution is measured by a HACH, DR-AC Colorimeter which is equippped with a red filter (No. 2408). The Colorimeter registers the percent of light which passes through the solution and is referred to as percent transmittance.

The solution containing no gilsonite is placed in the Colorimeter first. The Colorimeter is calibrated such that the quantity of light passing through the solution containing the standard solvent registers 100% transmittance. Thereafter, the solution containing gilsonite is placed in the thus calibrated Colorimeter and the percent transmittance registered for the gilsonite-containing sample is recorded.

The recorded percent transmittance value is then converted to absorbance value by the following mathematical relationship:

$$A = \log (1/T)$$

wherein $A$ = absorbance, and $T$ = transmittance expressed as a decimal fraction.

Absorbance, according to Beer's Law, is directly proportional to the concentration of absorbing species in the solution. The recorded percent transmittance is a direct measure of the particular solvent's ability to dissolve gilsonite, because the absorbance due to the presence of the various constituents of the solvent is compensated for by calibrating the colorimeter to register 100% transmittance for the gilsonite-free solvent. Therefore, the calculated absorbance values from different solvents can be directly compared to obtain the relative ranking of different solvents with respect to their ability to dissolve gilsonite, wherein the higher the absorbance the greater the ability to dissolve gilsonite.

Table I, below, sets out calculated gilsonite absorbance values for various solvents. The absorbance values are obtained according to the above procedure.

TABLE I

| Run | Solvent[1] | Absorbance |
|---|---|---|
| 1 | HAS[2] + 1% A[3] + 1% B[4] | 1.4 |
| 2 | HAS + 0.6% Batu Gum | 1.7 |
| 3 | HAS | 1.9 |
| 4 | HAS + 1% A + 1% C[5] | 1.9 |
| 5 | HAS + 1% A + 0.6% Batu Gum | 2.5 |
| 6 | HAS + 1% A | 4.5 |
| 7 | HAS + 1% A + 0.12% Batu Gum | 6.2 |

Notes:
[1]The solvent is a mixture of heavy aromatic solvent (HAS) plus (except run 3) an additive or additives whose presence is expressed as a weight percent of HAS.
[2]A liquid heavy aromatic solvent having a flash point of 178° F.
[3]Benzotriazole
[4]A commercially available nonionic surfactant.
[5]A commercially Commercially available mixture of nonionic and cationic surfactants.

From Table I (runs 3 and 6) it can be seen that addition of small quantities of benzotriazole to the heavy aromatic solvent greatly enhances the ability of the heavy aromatic solvent to dissolve gilsonite.

Also from Table I (runs 1, 4 and 6) it can be seen that surfactants can diminish the ability of benzotriazole-heavy aromatic solvent to dissolve gilsonite. The effect of the addition of a natural gum on the dissolving power of the heavy aromatic solvent-benzotriazole combination is seen in runs 5, 6 and 7 of Table I.

EXAMPLE II

Twenty-five (25) grams of gilsonite are placed in a small jar containing 50 milliliters of a heavy aromatic solvent having a flash point of 180° F. The solvent is preheated for 1 hour at 175° F. After the gilsonite is placed in the jar, the jar is placed in a constant temperature shaker bath. The temperature of the bath is maintained at 175° F. The jar and its contents are shaken for a one hour period. At the end of the one hour period, the contents of the jar are filtered through No. 541 filter paper. Following the procedure set out in Example I, the filtrate was diluted with mixed xylenes and the percent transmittance was measured using a Hach colorimeter and a number 2408 filter. Concurrently, another run is conducted that is identical in all respects except that is contains 1.5 grams of benzotriazole in the heavy aromatic solvent. Following the procedure set out in Example I the percent transmittance of the filtrate is measured. The difference in the transmittance measurements indicates that the aromatic solvent containing the benzotriazole dissolved 1.45 times as much of the gilsonite as did the aromatic solvent without the benzotriazole.

EXAMPLE III

A sample of carbonaceous deposit is obtained from the tube side of a heat exchange leading to an atmospheric crude unit. The deposit contains iron sulfide ($FeS_2$) and a degraded carbonaceous residue. Two 1-gram portions of the sample are treated at 176° F with 100 milliliters of a heavy aromatic solvent having a flash point of 178° F with and without the addition of 1 gram of benzotriazole for 6 hour periods. In the run without the benzotriazole, 23 percent of the organic portion of the scale was dissolved. In the run containing the benzotriazole, 38 percent of the organic portion of the deposit was dissolved.

EXAMPLE IV

A sample of carbonaceous deposit is obtained from the shell side of a heat exchanger leading to an atmospheric crude unit. The deposit contains magnetite ($FE_3O_4$), galena (PbS), and a degraded carbonaceous residue. One gram portions are treated as in Example III. The run that contains no benzotriazole dissolves 76 percent of the organic portion of the scale. The run that contains the benzotriazole dissolves 83 percent of the organic portion of the scale.

EXAMPLE V

A sample of carbonaceous deposit is obtained from the tube side of a heat exchanger leading to an atmospheric crude unit. The scale contains iron sulfide ($FeS_2$), galena and sodium chloride, plus a degraded organic residue. Two portions of the sample are treated as in Example III, the run without benzotriazole dissolves 5 percent of the organic portion of the scale. The run with the benzotriazole present dissolves 13 percent of the organic residue.

Although only small amounts of the organic residue is actually soluble, there is a significant difference in the two runs. As indicated earlier, this invention includes dissolving soluble material in a matrix to thereby enable the insoluble material to more easily be removed by such techniques as a simple water flush.

EXAMPLE VI

The effectiveness of a cleaning solution in an aqueous emulsion formulation containing benzotriazole and a liquid heavy aromatic solvent is demonstrated by cleaning a severely fouled heat exchanger in an atmospheric crude unit. The extent of fouling is so severe that a decision is made to discard the exchanger and replace it with a new one. This decision results in the release of the heat exchanger for experimental use.

The emulsion formulation to be used consists of 30 volume percent oil phase and 70 volume percent aqueous phase. The oil phase consists of 120 gallons (948 pounds) of heavy aromatic solvent containing 5 pounds of benzotriazole and 1 quart of a commercially available mixture of nonionic and cationic surfactants. The aqueous phase consists of 280 gallons of water containing 3 percent NaOH by weight of water, 1 percent trisodium phosphate by weight of water, 1 percent sodium metasilicate by weight of water, and 1 quart of a commercially available mixture of nonionic and amphoteric surfactants.

Each phase is mixed separately in two 500 gallon tanks before being transported to the location of the heat exchanger. Upon arrival at the location of the heat exchanger, the hook-up of the circulating loop to the shell side of the exchanger for cleaning is effected.

At time 0:00, the circulation of the cleaning formulation is started. The oil phase is circulated while the aqueous phase is slowly added. Heating is started simultaneously. Heating is accomplished with a small auxiliary heat exchanger. The initial temperature of the solution being circulated is 80° F.

At 0:05, the steam line leading to the small auxiliary heat exchanger bursts and repairs are made. Circulation is continued during this repair work but no more aqueous phase is added. Approximately one-third of the aqueous phase is added before the line bursts. It is observed that the emulsion is oil external at this point. The emulsion turns black during the first 15 minutes of circulation.

By 0:30, the steam line is repaired and another one-third of the aqueous phase is added. The temperature of the emulsion is 100° F. Heating is initiated again.

At 0:40, the last one-third of the aqueous phase is added. The temperature drops from 120° F to 105° F and the emulsion inverts.

A time 1:00, the steam is shut down for more repair work. The steam line nozzle is leaking. This repair work is completed by 1:10.

At 1:30, the temperature is 155° F. It is observed at this time that the emulsion is breaking. There are streaks of oil phase dispersed through the emulsion.

At time 2:00, the temperature of the emulsion reaches 180° F.

Circulation is continued at 180°–190° F until time 6:00 at which time the heat exchanger is drained and flushed with water for 15 minutes.

The piping to the heat exchanger is disconnected and the heat exchanger is visually inspected through the 4 inch inlet. Before cleaning, it is impossible to see past the first layer of tubes in the bundle. After the cleaning job, one can see into the bundle to a depth of several tube diameters (5–6 diameters). It is noticed that chunks of coke are lodged between certain tubes in the bundle. Many of the chunks dislodged during the cleaning because they are easily moved with a welding rod that is available for use as a poker.

This invention is not limited to the above described specific embodiments thereof; it must be understood therefore that the detail involved in the descriptions of the specific embodiments is presented for the purpose of illustration only, and that reasonable variations and modifications, which will be apparent to those skilled in the art, can be made in this invention without departing from the spirit or scope thereof.

Having thus described the invention, that which is claimed is:

1. A method for dissolving asphaltic material comprising:

establishing contact between said asphaltic material and a composition comprising a liquid aromatic solvent and an additive material soluble in said liquid aromatic solvent, and maintaining said contact for a time sufficient to dissolve said asphaltic material;

wherein said liquid aromatic solvent has a flash point of at least about 160° F and is a mixture of aromatic compounds selected from alkyl substituted benzene compounds having 1 to 10 carbon atoms per alkyl substituent, naphthalene, and alkyl substituted naphthalene having 1 to 10 carbon atoms per alkyl substituent; and wherein said additive material is benzotriazole and is, present in said composition in the range of from about 0.1 to about 50 percent by weight of said liquid aromatic solvent.

2. The method of claim 1 wherein said contact between said asphaltic material and said composition is conducted at a temperature in the range of from about 75° F to about the flash point of said liquid aromatic solvent.

3. The method of claim 2 wherein the flash point of said liquid aromatic solvent is in the range of from about 160° F to about 350° F.

4. The method of claim 3 wherein the flash point of said liquid aromatic solvent is in the range of from about 180° F to about 250° F.

5. The method of claim 4 wherein said additive material is present in said composition in the range of from about 0.3 to about 30 percent by weight of said liquid aromatic solvent.

6. The method of claim 3 wherein said composition is the oil phase of an oil and water emulsion and said asphaltic material is the binder material of a carbonaceous scale and further wherein said carbonaceous scale is adhering to a metallic substrate.

7. The method of claim 6 wherein said oil phase is present in the range of from about 2 to about 60 percent by volume of said emulsion.

8. The method of claim 4 wherein said liquid aromatic solvent is a mixture of aromatic compounds selected from the group consisting of ethylbenzene, amylbenzene, 2-phenylbutane, t-butylbenzene, 1,2-diethylbenzene,1,3-diethylbenzene, 1,4-diethylbenzene, 1-methylanaphthalene, 1-ethylnaphthalene, and 2-ethylnaphthalene,1,4-dimethylnaphthalene.

9. The method of claim 5 wherein said additive material is benzotriazole, said liquid aromatic solvent has a flash point of about 200° F and said benzotriazole is present in said composition in the range of from about 0.5 to about 3 percent by weight of said liquid aromatic solvent.

10. The method of claim 9 wherein said liquid aromatic solvent is a mixture of aromatic compounds selected from the group consisting of ethylbenzene, amylbenzene, 2-phenylbutane, t-butylbenzene,1,2-diethylbenzene,1,3-diethylbenzene, 1,4-diethyl-benzene, 1-methylnaphthalene, 1-ethylnaphthalene, and 2-ethylnaphthalene,1,4-dimethylnaphthalene.

11. The method of claim 10 wherein said composition is the oil phase of an oil and water emulsion and said asphaltic material is the binder material of a carbonaceous scale and further wherein said carbonaceous scale is adhering to a metallic substrate.

12. The method of claim 11 wherein said oil phase is present in the range of from about 30 to about 40 percent by volume of said emulsion.

* * * * *